US008280727B2

(12) United States Patent
Endo et al.

(10) Patent No.: US 8,280,727 B2
(45) Date of Patent: Oct. 2, 2012

(54) VOICE BAND EXPANSION DEVICE, VOICE BAND EXPANSION METHOD, AND COMMUNICATION APPARATUS

(75) Inventors: Kaori Endo, Kawasaki (JP); Takeshi Otani, Kawasaki (JP); Taro Togawa, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 332 days.

(21) Appl. No.: 12/777,398

(22) Filed: May 11, 2010

(65) Prior Publication Data

US 2010/0318350 A1 Dec. 16, 2010

(30) Foreign Application Priority Data

Jun. 10, 2009 (JP) ..... 2009-139390

(51) Int. Cl.

| | |
|---|---|
| ***G10L 19/06*** | (2006.01) |
| *G10L 21/00* | (2006.01) |
| *G10L 19/14* | (2006.01) |
| *G10L 19/00* | (2006.01) |

(52) U.S. Cl. ..... 704/209; 704/201; 704/205; 704/219; 704/501

(58) Field of Classification Search ..... 704/209
See application file for complete search history.

(56) References Cited

U.S. PATENT DOCUMENTS

| | | | | |
|---|---|---|---|---|
| 7,280,959 | B2 * | 10/2007 | Bessette | 704/219 |
| 7,613,604 | B1 * | 11/2009 | Malah et al. | 704/205 |
| 7,742,914 | B2 * | 6/2010 | Kosek et al. | 704/205 |
| 7,805,314 | B2 * | 9/2010 | Sung et al. | 704/501 |
| 8,032,359 | B2 * | 10/2011 | Shlomot et al. | 704/201 |
| 8,190,032 | B2 * | 5/2012 | Futami et al. | 398/176 |

FOREIGN PATENT DOCUMENTS

| | | |
|---|---|---|
| JP | 8-248997 | 9/1996 |

* cited by examiner

*Primary Examiner* — Pierre-Louis Desir
*Assistant Examiner* — Neeraj Sharma
(74) *Attorney, Agent, or Firm* — Staas & Halsey LLP

(57) ABSTRACT

A voice band expansion device includes a time-frequency converter that calculates a frequency spectrum of a voice signal having a first frequency band; a separator that extracts, from the frequency spectrum, an envelope amplitude spectrum, a periodic amplitude spectrum, and a random amplitude spectrum; an envelope amplitude spectrum band expander that expands a frequency band to a second frequency band that is different from the first frequency band; a periodic amplitude spectrum band expander that expands a frequency band to the second frequency band; a random amplitude spectrum band expander that expands a frequency band of the random amplitude spectrum to the second frequency band; a broadband spectrum calculator that calculates a broadband frequency spectrum having the first frequency band and the second frequency band; and a frequency-time converter generates a voice signal having the first frequency band and the second frequency band.

18 Claims, 8 Drawing Sheets

VOICE BAND EXPANSION DEVICE, VOICE BAND EXPANSION METHOD, AND COMMUNICATION APPARATUS

CROSS-REFERENCE TO RELATED APPLICATIONS

This application is based upon and claims the benefit of priority of the prior Japanese Patent Application No. 2009-139390 filed on Jun. 10, 2009, the entire contents of which are incorporated herein by reference.

FIELD

A certain aspect of the embodiment discussed herein is related to a voice band expansion device, voice band expansion method and communication apparatus that expand a frequency band of a voice signal.

BACKGROUND

In order to transmit a voice signal in a limited frequency band in a voice transmission system, in general, the frequency band of the voice signal is narrowed and the band-narrowed voice signal is transmitted. Thus, a frequency band in which a voice reproduced by a receiver that has received the voice signal is included becomes narrower than the frequency band in which the original voice is included, resulting in deterioration of the quality of the voice reproduced by the receiver. For that reason, a technique that improves the quality of a reproduced voice by expanding a frequency band, in which a voice signal is included, in a pseudo manner is disclosed, for example, in Japanese Laid-open Patent Publication No. H8-248997.

In the technique disclosed in Japanese Laid-open Patent Publication No. H8-248997, spectrum envelope information and a residual signal are extracted from an input signal. Then, the frequency band of the spectrum envelope information and the frequency band of the residual signal are expanded, and a voice is synthesized by using the spectrum envelope information and the residual signal the frequency bands of both of which have been expanded.

SUMMARY

In accordance with an aspect of the embodiments, a voice band expansion device includes a time-frequency converter that calculates a frequency spectrum of a voice signal having a first frequency band, by performing time-frequency conversion on the voice signal every frame having a predetermined time length; a separator that extracts, from the frequency spectrum, an envelope amplitude spectrum of the frequency spectrum, a periodic amplitude spectrum whose spectrum intensity periodically changes in response to frequency, and a random amplitude spectrum whose spectrum intensity randomly changes in response to frequency; an envelope amplitude spectrum band expander that expands a frequency band of the envelope amplitude spectrum to a second frequency band that is different from the first frequency band; a periodic amplitude spectrum band expander that expands a frequency band of the periodic amplitude spectrum to the second frequency band; a random amplitude spectrum band expander that expands a frequency band of the random amplitude spectrum to the second frequency band; a broadband spectrum calculator that calculates a broadband frequency spectrum having the first frequency band and the second frequency band, by combining the band-expanded envelope amplitude spectrum, the band-expanded periodic amplitude spectrum, and the band-expanded random amplitude spectrum; and a frequency-time converter that generates a voice signal having the first frequency band and the second frequency band, by performing frequency-time conversion on the broadband frequency spectrum.

The object and advantages of the invention will be realized and attained by means of the elements and combinations particularly pointed out in the claims. It is to be understood that both the foregoing general description and the following detailed description are exemplary and explanatory and are not restrictive of the various embodiments, as claimed.

The above-described embodiments of the present invention are intended as examples, and all embodiments of the present invention are not limited to including the features described above.

DESCRIPTION OF EMBODIMENTS

Figure 1:
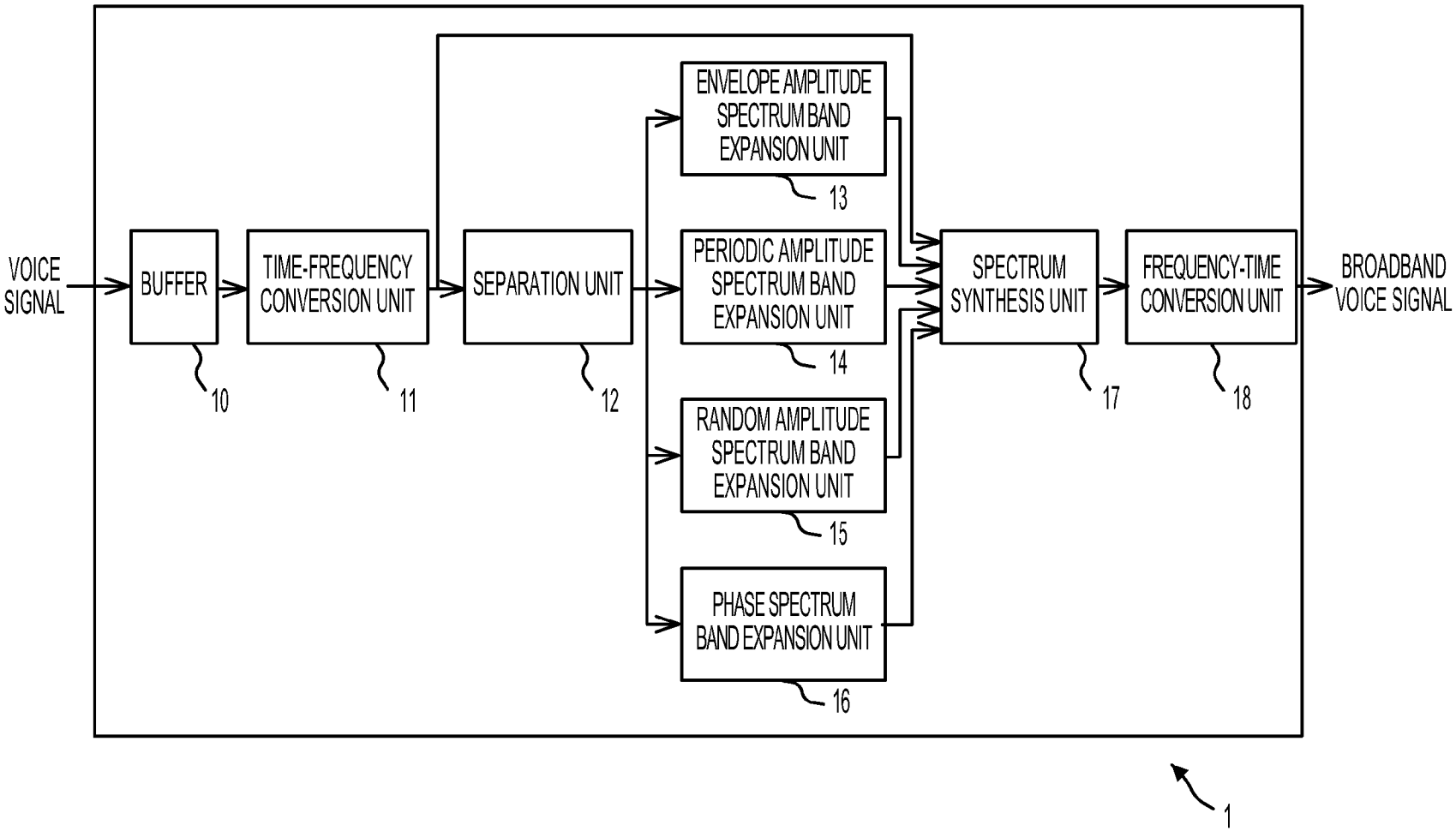
FIG. 1 is a schematic configuration diagram of a voice band expansion device according to an embodiment.

Reference may now be made in detail to embodiments of the present invention, examples of which are illustrated in the accompanying drawings, wherein like reference numerals refer to like elements throughout.

As a result of research concerning the above existing technique, the inventor has found the following issue. Like a voice of a person, a voice signal sometimes includes: a periodic amplitude spectrum in which the amplitude value of the frequency spectrum of the voice signal periodically changes in response to change in frequency; and a random amplitude spectrum in which the amplitude value of the frequency spectrum changes in a random manner, not in response to change in frequency. However, in the existing technique, a periodic amplitude spectrum and a random amplitude spectrum are not separated from an inputted voice signal, and the frequency bands of spectrum envelope information and a residual signal are expanded. Moreover, in the existing technique, a phase spectrum that indicates a phase at each frequency is not taken into consideration. Thus, in the existing technique, it is impossible to expand the frequency bands of the periodic amplitude spectrum, the random amplitude spectrum, and the phase spectrum in accordance with their characteristics, respectively.

In order to expand the frequency band of a voice signal such that natural sound quality is provided, it is desired that the band-expanded periodic amplitude spectrum and the band-expanded random amplitude spectrum have the same characteristics as those of the periodic amplitude spectrum and the random amplitude spectrum corresponding to the original voice signal. For example, the gradient of the envelope of the periodic amplitude spectrum with respect to frequency is sometimes different from the gradient of the envelope of the random amplitude spectrum with respect to frequency. In such a case, in the existing technique, the frequency band of the voice signal cannot be expanded while the gradient of the envelope of each amplitude spectrum is maintained. Thus, the characteristics of the band-expanded periodic amplitude spectrum and the band-expanded random amplitude spectrum are different from the characteristics of the periodic amplitude spectrum and the random amplitude spectrum corresponding to the original voice signal. This results in deterioration of the quality of the band-expanded voice signal.

In addition, it is generally known that, in a periodic amplitude spectrum, the periodicity weakens as the frequency increases. However, in the existing technique, because a periodic amplitude spectrum cannot be individually separated and its frequency band cannot be expanded, properties of such a periodic amplitude spectrum cannot be reproduced. Thus, a reproduced voice sometimes does not become a natural voice.

Moreover, in the existing technique, the continuity of phase between frames, each of which is unit per which an inputted voice signal is to be analyzed, is not taken into consideration. Thus, there is the possibility that the phase defined by the frequency of the voice and the corresponding angular velocity, becomes discontinuous between the frames. Then, if the phase becomes discontinuous between the frames, the reproduced voice signal becomes discontinuous, resulting in deterioration of the quality of the reproduced voice signal.

The following will describe a voice band expansion device according to an embodiment. The voice band expansion device separates an inputted voice signal into an envelope amplitude spectrum, a periodic amplitude spectrum, a random amplitude spectrum, and a phase spectrum. Then, the voice band expansion device improves the quality of a reproduced voice, by expanding the frequency band of each spectrum toward the high frequency side in accordance with the characteristic of each spectrum. It is noted that, in the embodiment, as an example, the voice signal inputted to the voice band expansion device is included in the frequency band of 300 Hz to 4 kHz. Then, the voice band expansion device expands the frequency band of the voice signal by generating a voice signal component included in the frequency band of 4 kHz to 8 kHz, in a pseudo manner. However, the frequency band of the inputted voice signal is not limited to 300 Hz to 4 kHz. The frequency band of the inputted voice signal may be 300 Hz to 3.4 kHz. In addition, the frequency band of the voice signal component generated by the voice band expansion device in a pseudo manner is not limited to 4 kHz to 8 kHz. For example, the voice band expansion device may generate a voice signal component included in the frequency band of 4 kHz to 16 kHz. Further, the voice band expansion device may generate a voice signal component included in an audible band of frequencies that are lower than the lower limit of the frequency band of the inputted voice signal, for example, in the frequency band of 50 Hz to 300 Hz.

FIG. 1 is a schematic configuration diagram of a voice band expansion device according to the embodiment. The voice band expansion device 1 includes a buffer memory 10, a time-frequency converter 11, a separator 12, an envelope amplitude spectrum band expander 13, a periodic amplitude spectrum band expander 14, a random amplitude spectrum band expander 15, a phase spectrum band expander 16, a spectrum synthesis unit 17, and a frequency-time converter 18.

Each unit of the voice band expansion device 1 is formed as a separate circuit. Alternatively, these units of the voice band expansion device 1 may be mounted in the voice band expansion device 1, as an integrated circuit in which circuits corresponding to these units, respectively, are integrated. Still alternatively, these units of the voice band expansion device 1 may be a functional module that is implemented by a computer program executed on a processor that is included in the voice band expansion device 1.

The buffer memory 10 temporarily stores an inputted voice signal. The inputted voice signal stored in the buffer memory 10 is read by the time-frequency converter 11 in a predetermined frame unit in order of input time.

The time-frequency converter 11 calculates a frequency spectrum of the inputted voice signal by performing time-frequency conversion on the inputted voice signal read from the buffer memory 10 in the predetermined frame unit. It is noted that time-frequency conversion performed by the time-frequency converter 11 may be, for example, fast Fourier transform or discrete cosine transform. In addition, the frame length may be any length in the range of 10 msec to 80 msec. Every time a frequency spectrum is calculated in the predetermined frame unit, the time-frequency converter 11 outputs the calculated frequency spectrum to the separator 12 and the spectrum synthesis unit 17.

Here, the frequency spectrum may be represented as a spectrum that is the combination of an envelope amplitude spectrum, a periodic amplitude spectrum, a random amplitude spectrum, and a phase spectrum. Among these spectra, the envelope amplitude spectrum, the periodic amplitude spectrum, and the random amplitude spectrum, all of which relate to amplitude, sometimes have different characteristics with respect to change in frequency.

Figure 2A:
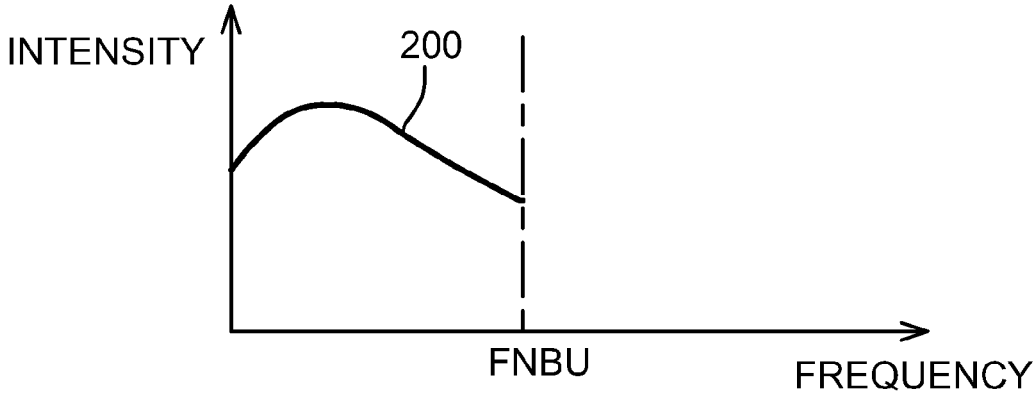
FIG. 2A shows one example of an envelope amplitude spectrum included in a frequency spectrum.
Figure 2B:
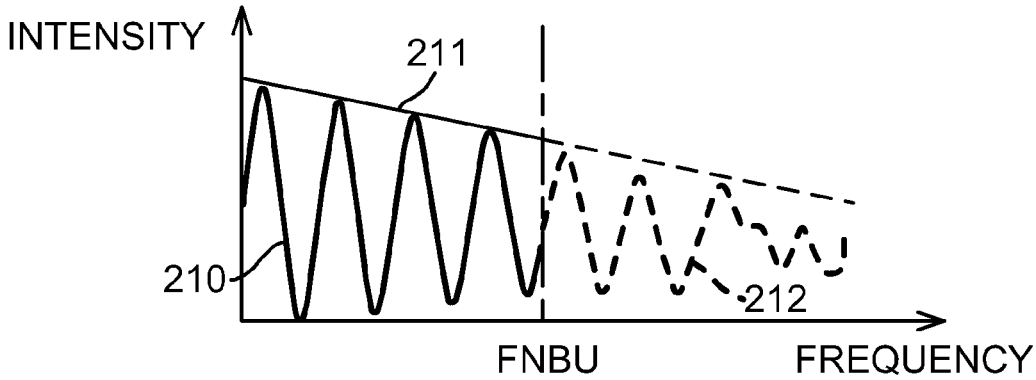
FIG. 2B shows one example of a periodic amplitude spectrum included in the frequency spectrum.
Figure 2C:
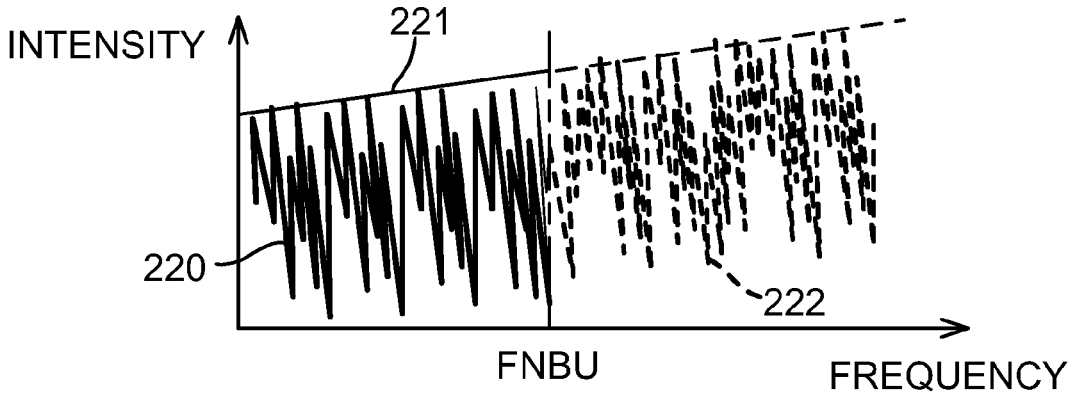
FIG. 2C shows one example of a random amplitude spectrum included in the frequency spectrum.

FIG. 2A shows one example of the envelope amplitude spectrum included in the frequency spectrum; FIG. 2B shows one example of the periodic amplitude spectrum included in the frequency spectrum; FIG. 2C shows one example of the random amplitude spectrum included in the frequency spectrum. In FIGS. 2A to 2C, the horizontal axis indicates frequency, and the vertical axis indicates intensity of the spectrum. In addition, a frequency fnbu indicates the upper limit of the frequency band of the inputted voice signal.

As shown in FIG. 2A, an envelope amplitude spectrum 200 has, for example, a spectrum shape in which the intensity becomes the maximum at a specific frequency and gently decreases as the frequency increases from the specific frequency. Further, as shown in FIG. 2B, in a periodic amplitude spectrum 210, the intensity periodically changes. In addition, the envelope 211 of the periodic amplitude spectrum 210 becomes a function in which the intensity decreases as the frequency increases. On the other hand, as shown in FIG. 2C, in a random amplitude spectrum 220, for example, the intensity entirely increases as the frequency increases. Thus, the envelope 221 of the random amplitude spectrum 220 becomes a function in which the intensity increases as the frequency increases.

As described above, the envelope amplitude spectrum, the periodic amplitude spectrum, and the random amplitude spectrum have different characteristics with respect to change in frequency. In addition, in order that the reproduced voice signal becomes a natural voice, each amplitude spectrum generated in a pseudo manner in a frequency band higher than the frequency fnbu also has the same characteristic as the characteristic of each amplitude spectrum with respect to change in frequency lower than the frequency fnbu.

For example, it is preferred that the local maximum value of a periodic amplitude spectrum 212 generated in a pseudo manner in the high frequency band higher than the frequency fnbu also decreases along the envelope 211 as the frequency increases. Further, it is preferred that the local maximum value of a random amplitude spectrum 222 generated in a pseudo manner in the high frequency band higher than the frequency fnbu also increases along the envelope 221 as the frequency increases.

Every time a frequency spectrum is received from the time-frequency converter 11, the separator 12 extracts an envelope amplitude spectrum, a periodic amplitude spectrum, and a random amplitude spectrum from the frequency spectrum. Further, every time a frequency spectrum is received from the time-frequency converter 11, the separator 12 also extracts a phase spectrum from the frequency spectrum.

Figure 3:
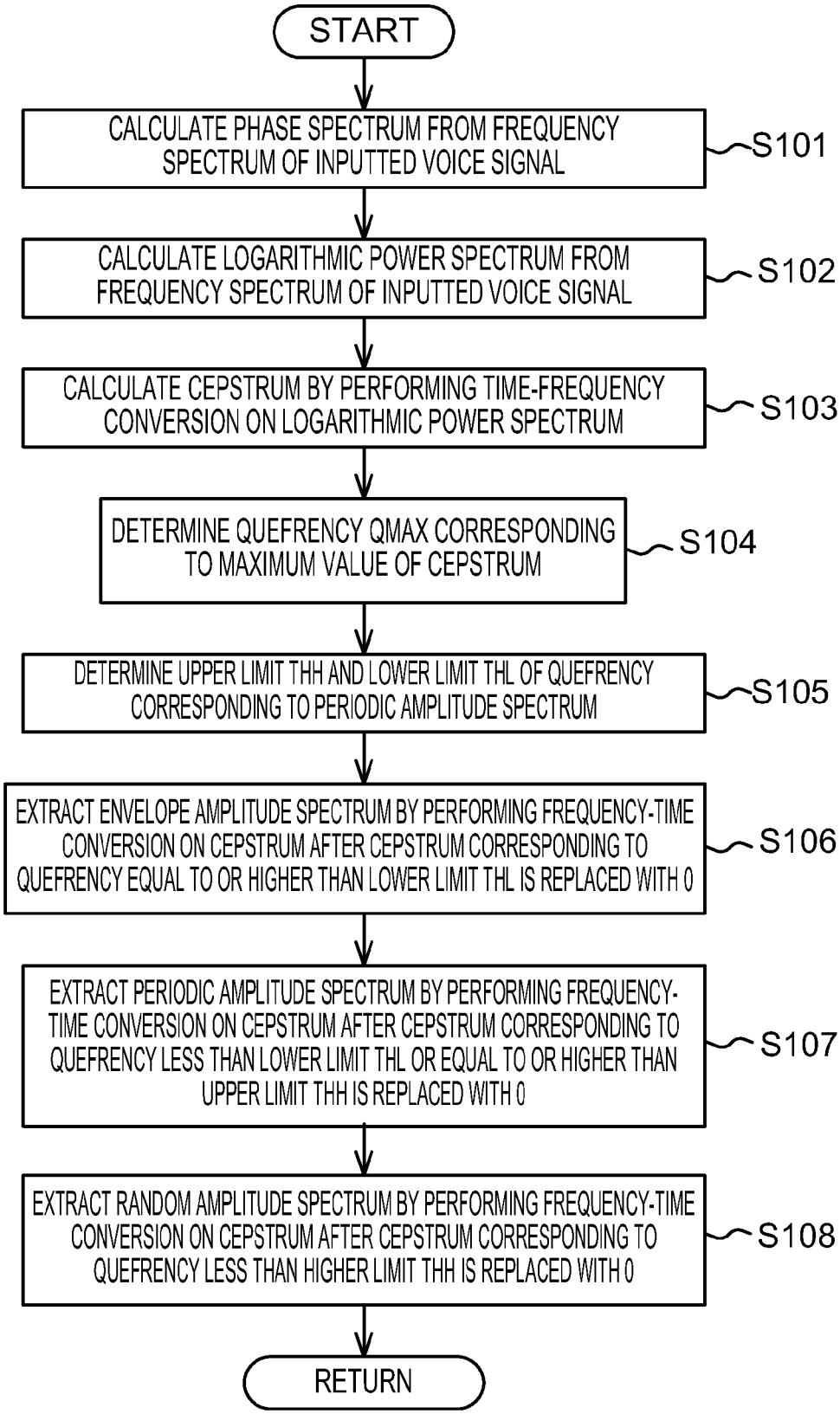
FIG. 3 is an operational flow chart of a frequency spectrum separation process.

FIG. 3 is an operational flow chart of a frequency spectrum separation process performed by the separator 12. The separator 12 calculates a phase spectrum from a frequency spectrum according to the following formula (1) (operation S101).

$$ps[f] = \tan^{-1}\frac{\mathrm{im}[f]}{\mathrm{re}[f]} \tag{1}$$

In the formula (1), f denotes a frequency, and ps[f] denotes a phase spectrum that indicates a phase with respect to the frequency f. Further, re[f] denotes the real part component of the frequency spectrum with respect to the frequency f, and im[f] denotes the imaginary part component of the frequency spectrum with respect to the frequency f.

Further, the separator 12 calculates a logarithmic power spectrum from the frequency spectrum according to the following formula (2) (operation S102).

$$lps[f]=10\log_{10}(re[f]^2+im[f]^2) \tag{2}$$

In the formula (2), f denotes a frequency, and lps[f] denotes a logarithmic power spectrum represented as a function of the frequency f. Further, re[f] denotes the real part component of the frequency spectrum with respect to the frequency f, and im[f] denotes the imaginary part component of the frequency spectrum with respect to the frequency f. After the calculation of the logarithmic power spectrum, the separator 12 calculates a cepstrum by performing time-frequency conversion on the logarithmic power spectrum (operation S103). It is noted that, for example, fast Fourier transform or discrete cosine transform is used as the time-frequency conversion. Then, the separator 12 obtains a quefrency Qmax at which the cepstrum becomes the maximum (operation S104). It is noted that Qmax corresponds to the pitch frequency of the periodic amplitude spectrum.

Next, in order to extract an envelope amplitude spectrum, a periodic amplitude spectrum, and a random amplitude spectrum from the frequency spectrum, the separator 12 determines the upper limit and the lower limit of the quefrency corresponding to the periodic amplitude spectrum, according to the following formulas (3) and (4) (operation S105).

$$TH_L=Q\max*\mathrm{COEF}_L \tag{3}$$

$$TH_H=Q\max*\mathrm{COEF}_H \tag{4}$$

Here, THL denotes the lower limit of the quefrency corresponding to the periodic amplitude spectrum, and THH denotes the upper limit of the quefrency corresponding to the periodic amplitude spectrum. Further, COEFL denotes a coefficient for calculating the lower limit THL of the quefrency corresponding to the periodic amplitude spectrum. The coefficient COEFL is set to be any number that satisfies the following condition.

$$0\leqq \mathrm{COEFL}\leqq 1 \tag{5}$$

COEFH denotes a coefficient for calculating the upper limit THH of the quefrency corresponding to the periodic amplitude spectrum. The coefficient COEFH is set, for example, to be any number that satisfies the following condition.

$$1<\mathrm{COEFH}<3 \tag{6}$$

After the upper limit and the lower limit of the quefrency corresponding to the periodic amplitude spectrum are determined, the separator 12 extracts an envelope amplitude spectrum from the cepstrum (operation S106). At this time, the separator 12 replaces a component of the cepstrum corresponding to the quefrency that is equal to or higher than the lower limit THL, with 0. Then, the separator 12 calculates the envelope amplitude spectrum by performing frequency-time conversion on the cepstrum after the replacement. In addition, the separator 12 extracts the periodic amplitude spectrum from the cepstrum (operation S107). At this time, the separator 12 replaces a component of the cepstrum corresponding to the quefrency that is less than the lower limit THL, with 0, and replaces a component of the cepstrum corresponding to the quefrency that is equal to or higher than the upper limit THH, with 0. Then, the separator 12 calculates the periodic amplitude spectrum by performing frequency-time conversion on the cepstrum after the replacement. It is noted that, when the difference between THL and THH is small, only a spectrum corresponding to the pitch frequency of the periodic amplitude spectrum is calculated.

Further, the separator 12 extracts a random amplitude spectrum from the cepstrum (operation S108). At this time, the separator 12 replaces a component of the cepstrum corresponding to the quefrency that is less than the upper limit THH, with 0. Then, the separator 12 calculates the random amplitude spectrum by performing frequency-time conversion on the cepstrum after the replacement.

It is noted that the frequency-time conversion performed at operations S106 to S108 is the inverse transform of time-frequency conversion performed at operation S103. Further, the separator 12 may perform the process at operation S101 in parallel with the processes at operations S102 to S108. Alternatively, the separator 12 may change the performing order of the process at operation S101 and the processes at operations S102 to S108. Still alternatively, the separator 12 may change the performing order of the processes at operations S106 to S108.

The separator 12 passes the envelope amplitude spectrum to the envelope amplitude spectrum band expander 13. In addition, the separator 12 passes the original frequency spectrum, the periodic amplitude spectrum, the maximum value of the cepstrum, and the quefrency Qmax corresponding to this maximum value, to the periodic amplitude spectrum band expander 14. Further, the separator 12 passes the random amplitude spectrum to the random amplitude spectrum band expander 15. Then, the separator 12 passes the original frequency spectrum and the phase spectrum to the phase spectrum band expander 16.

The envelope amplitude spectrum band expander 13 expands the frequency band of the envelope amplitude spectrum received from the separator 12. For this, on the basis of the envelope amplitude spectrum received from the separator 12, the envelope amplitude spectrum band expander 13 generates an envelope amplitude spectrum having a high frequency band higher than the upper limit of the frequency band of the inputted voice signal. It is noted that the high frequency band is, for example, 4 kHz to 8 kHz.

Figure 4:
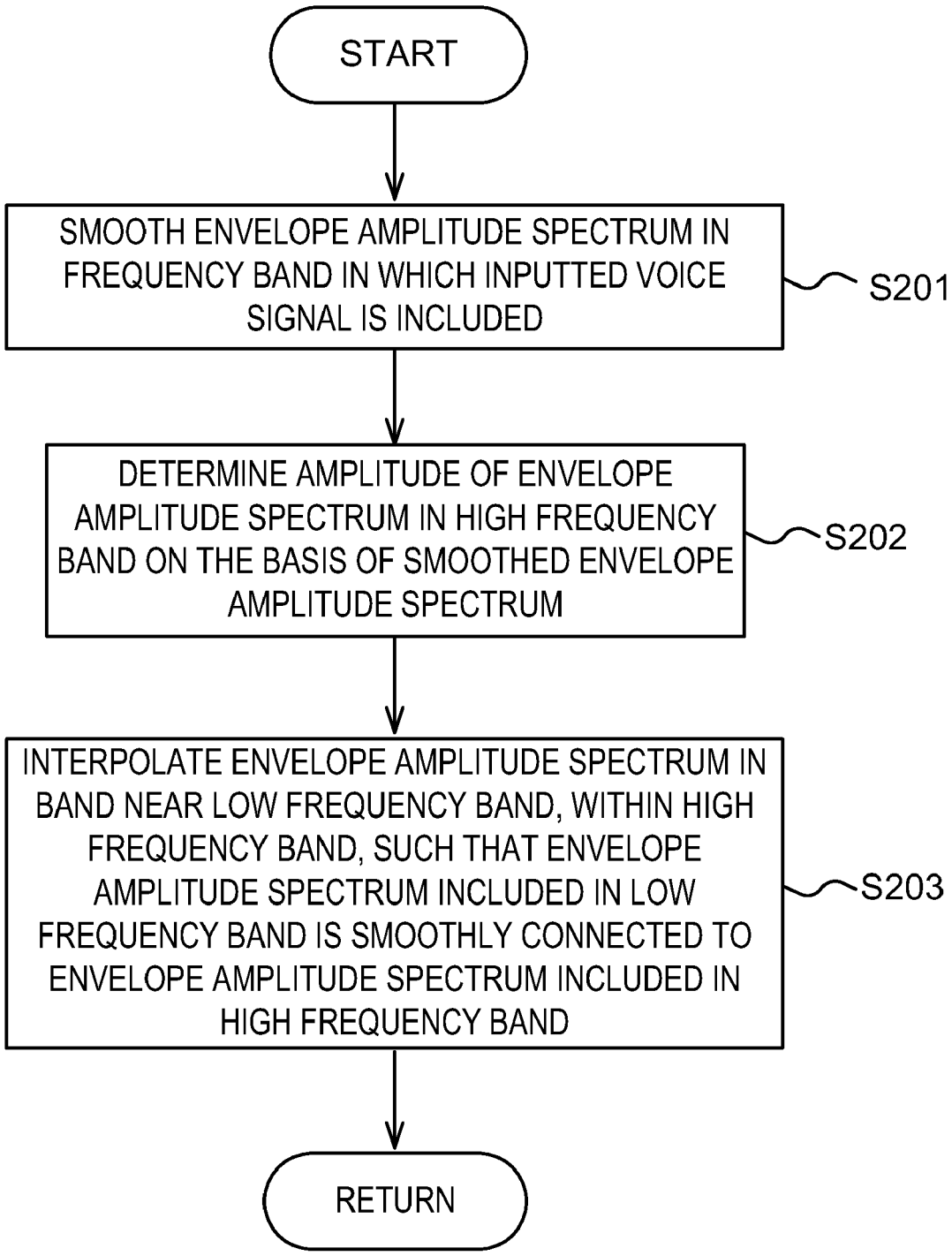
FIG. 4 is an operational flow chart of a high frequency band envelope amplitude spectrum generation process.

FIG. 4 is an operational flow chart of a high frequency band envelope amplitude spectrum generation process performed by the envelope amplitude spectrum band expander 13. The envelope amplitude spectrum band expander 13 smoothes the envelope amplitude spectrum received from the separator 12, in the frequency direction (operation S201). For example, the envelope amplitude spectrum band expander 13 smoothes the envelope amplitude spectrum according to the following formula (7).

$$PEsm(f) = \frac{1}{2w+1}\sum_{i=-w}^{i=w} PE(f+i) \tag{7}$$

Here, the function PE(f) denotes an envelope amplitude spectrum with respect to a frequency f, and the function Pesm(f) denotes an envelope amplitude spectrum smoothed with respect to the frequency f. Further, w denotes the width of the frequency band to be smoothed, and, for example, w is set to be 100 Hz.

Next, on the basis of the smoothed envelope amplitude spectrum, the envelope amplitude spectrum band expander 13 determines the amplitude of the envelope amplitude spectrum in the high frequency band (operation S202). For example, the envelope amplitude spectrum band expander 13 determines the amplitude of the envelope amplitude spectrum in the high frequency band, according to the following formula (8).

$$PE(f)=\text{rate}*PEsm(f-f_L)(f\geqq f_L+\Delta w) \tag{8}$$

Here, the coefficient rate denotes an average power ratio of a voice of a high frequency band with respect to a voice of a low frequency band, which ratio is previously obtained by using a voice that has a frequency band equal to the frequency band of the voice outputted by the voice band expansion device 1 and that contains voices of various speakers and vocal contents. This low frequency band is the frequency band of the inputted voice signal. On the other hand, this high frequency band is the frequency band of the envelope amplitude spectrum generated by the envelope amplitude spectrum band expander 13. In addition, fL denotes the lower limit of the high frequency band. In the embodiment, fL is 4 kHz. Further, Δw corresponds to a bandwidth for smoothly connecting the envelopes in the high frequency band and the low frequency band. For example, Δw is set to be 100 Hz.

The envelope amplitude spectrum band expander 13 interpolates an envelope amplitude spectrum in a band near the low frequency band, within the high frequency band, such that the envelope amplitude spectrum in the low frequency band is smoothly connected to the envelope amplitude spectrum in the high frequency band (operation S203). For example, the envelope amplitude spectrum band expander 13 determines the envelope amplitude spectrum in the band near the low frequency band, within the high frequency band, according to the following formula (9).

$$PE(f) = (1 - coef) * PEsm(f_L) + coef * rate * PEsm(f - f_L) \tag{9}$$

$$f_L < f < f_L + \Delta w \quad coef = \frac{f - f_L}{\Delta w}$$

It is noted that the envelope amplitude spectrum band expander 13 may generate the envelope amplitude spectrum in the high frequency band by another method. For example, the envelope amplitude spectrum band expander 13 may set the intensity of the envelope amplitude spectrum at the upper limit of the frequency band of the inputted voice signal, as the intensity of the envelope amplitude spectrum with respect to each frequency included in the high frequency band. Alternatively, the envelope amplitude spectrum band expander 13 may obtain a tangent line of the envelope amplitude spectrum or a cubic spline function that approximates the envelope amplitude spectrum, in the vicinity of the upper limit of the frequency band of the inputted voice signal, as the envelope amplitude spectrum in the high frequency band. The envelope amplitude spectrum band expander 13 outputs the envelope amplitude spectrum in the high frequency band to the spectrum synthesis unit 17.

The periodic amplitude spectrum band expander 14 expands the frequency band of the periodic amplitude spectrum received from the separator 12. For this, on the basis of the periodic amplitude spectrum received from the separator 12, the periodic amplitude spectrum band expander 14 generates a periodic amplitude spectrum in a high frequency band higher than the upper limit of the frequency band of the inputted voice signal. It is noted that the high frequency band is, for example, 4 kHz to 8 kHz.

Figure 5:
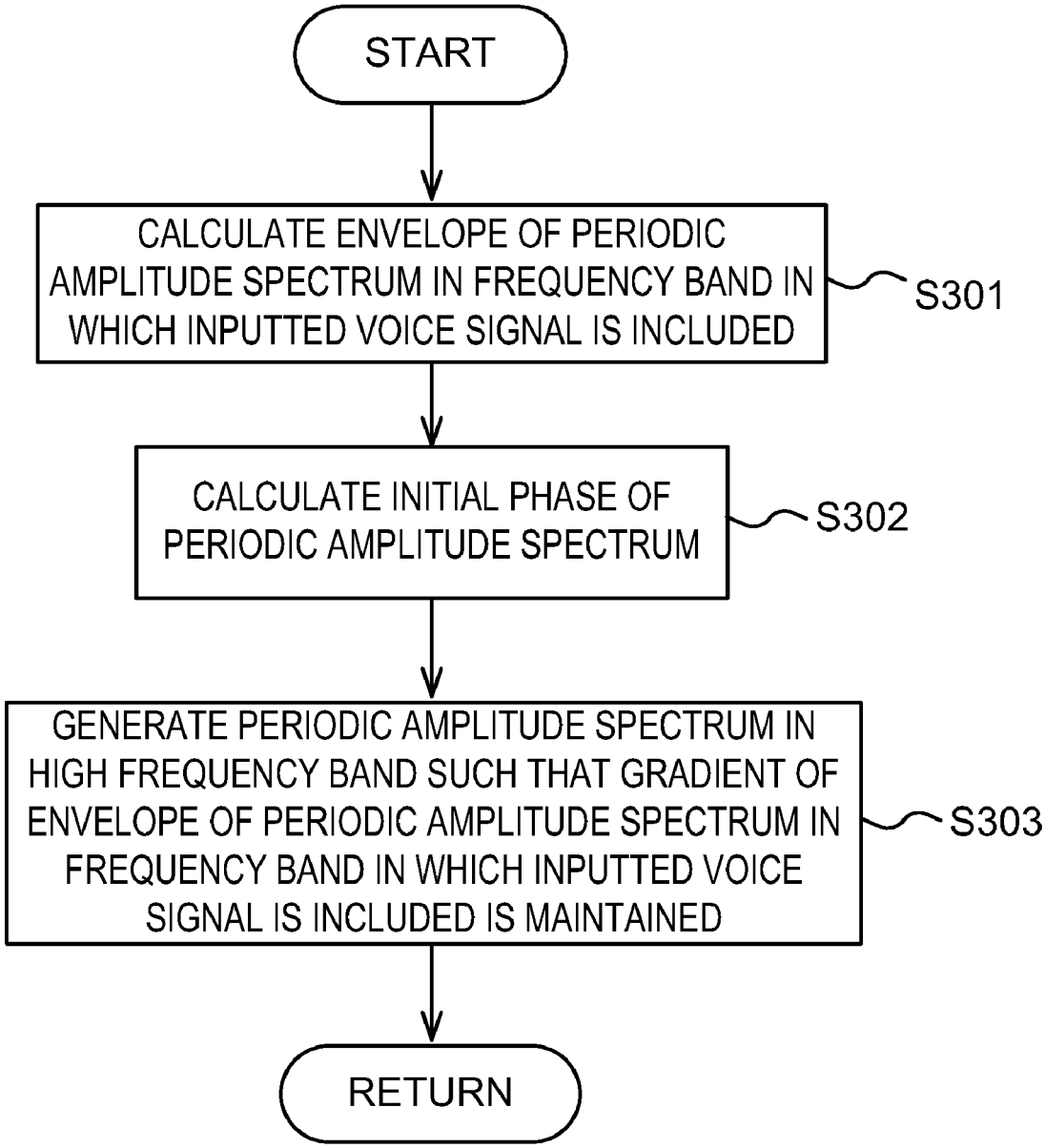
FIG. 5 is an operational flow chart of a high frequency band periodic amplitude spectrum generation process.

FIG. 5 is an operational flow chart of a high frequency band periodic amplitude spectrum generation process performed by the periodic amplitude spectrum band expander 14. The periodic amplitude spectrum band expander 14 calculates the envelope of the periodic amplitude spectrum received from the separator 12 (operation S301). In order to calculate the envelope, the periodic amplitude spectrum band expander 14 obtains local maximum points of the periodic amplitude spectrum. Each local maximum point is a point that satisfies the following condition, for example, where the intensity of the spectrum at a frequency fj is denoted by Ij (J=1, 2, . . . , n; note that n is the number of spectrum points included in one frame).

$$Ij-1<Ij \text{ and } Ij+1<Ij$$

The periodic amplitude spectrum band expander 14 calculates a straight line, I=af+b, that approximately connects each local maximum point (fj, Ij), as the envelope, for example, by using a least-squares method with respect to a set of the local maximum points (fj, Ij). Alternatively, the periodic amplitude spectrum band expander 14 may obtain a cubic spline function that connects each local maximum point (fj, Ij), and may calculate a cubic spline function at the local maximum point having the highest frequency, as a function that represents the envelope. Still alternatively, the periodic amplitude spectrum band expander 14 may obtain local minimum points each of which satisfies the following condition, instead of the local maximum points of the periodic amplitude spectrum.

$$Ij-1>Ij \text{ and } Ij+1>Ij$$

Then, the periodic amplitude spectrum band expander 14 may calculate the envelope by using the least-squares method or the cubic spline function with respect to a set of the local maximum points (fj, Ij) as described above.

Further, the periodic amplitude spectrum band expander 14 calculates the initial phase of the periodic amplitude spectrum according to the following formula (10) (operation S302).

$$\theta_0 = \tan^{-1}\frac{\mathrm{im}_p}{\mathrm{re}_p} \tag{10}$$

Here, θ0 denotes the initial phase of the periodic amplitude spectrum. In addition, rep denotes the real part of the maximum value of the cepstrum in the quefrency equal to or higher than the threshold THL and less than the threshold THH, which cepstrum corresponds to the periodic amplitude spectrum, and imp denotes the imaginary part of the maximum value of the cepstrum that corresponds to the periodic amplitude spectrum.

Next, the periodic amplitude spectrum band expander 14 generates the periodic amplitude spectrum in the high frequency band such that the gradient of the envelope of the periodic amplitude spectrum in the frequency band of the inputted voice signal is maintained (operation S303). At this time, in order that the reproduced voice becomes a natural voice, it is preferred that the periodic amplitude spectrum band expander 14 weakens the periodicity of the periodic amplitude spectrum as the frequency increases. The periodic amplitude spectrum band expander 14 may generate the periodic amplitude spectrum in the high frequency band, for example, according to the following formula (11).

$$PP(f) = (1 - c(f))s(f)\sin\left(\frac{2\pi f}{T} + \theta_{fL}\right) + c(f)r(f) \tag{11}$$

Here, the function PP(f) denotes the intensity of the periodic amplitude spectrum at a frequency f. In addition, the function c(f) is a function that increases as the frequency increases, the value of c(f) is included in the range of 0 to 1. For example, the following function may be used as the function c(f).

$$c(f)=(f-fL)/(fH-fL)$$

It is noted that fH and fL denote the upper limit and the lower limit, respectively, of the high frequency band. In addition, the function c(f) may be a nonlinear function. For example, the following function may be used as the function c(f).

$$c(f)=1/(1+e-\alpha(f-(fL+fH)/2))$$

The coefficient α is set such that the function c(f) becomes substantially 0 at the lower limit fL of the high frequency band and the function c(f) becomes substantially 1 at the upper limit fH of the high frequency band.

Further, in the formula (11), the function s(f) denotes the envelope. The function s(f) is the function of the envelope calculated at operation S301. Moreover, θfL denotes the phase of the frequency spectrum at the frequency fL, and obtained by the following formula.

$$\theta fL=\theta 0+fL*2\pi/f$$

Further, the function r(f) is a random function, and, for example, the value of r(f) is included in the range of 0 to 1. Moreover, T denotes the period of the periodic amplitude spectrum. The period T of the periodic amplitude spectrum is, for example, the value of a shift amount Δf by which an autocorrelation function ACF(j) of the periodic amplitude spectrum becomes an initial local maximum value when the shift amount Δf (Δf>0) of the frequency is changed from its initial value so as to be gradually increased. In addition, the initial value of the shift amount Δf is set to be any positive number that is empirically inferred to be smaller than the period T. For example, the autocorrelation function ACF(j) is represented by the following formula (12).

$$ACF(j) = \frac{\sum_{i=1}^{N} NP(i)NP(i+j)}{\sqrt{\sum_{i=1}^{N} NP(i)^2}\sqrt{\sum_{i=1}^{N} NP(i+j)^2}} \tag{12}$$

It is noted that NP(i) (i=1, 2, . . . , N) denotes a vector that represents the frequency spectrum calculated by the time-frequency converter 11. The value of each element of the vector is an amplitude value of a sub-frequency band obtained by equally dividing the frequency band of the inputted voice signal into N sub-frequency bands. In addition, N denotes the number of the elements of the vector that represents the frequency spectrum. Then, j corresponds to the shift amount Δf of the frequency. The shift amount Δf of the frequency is calculated by multiplying j by the width of the sub-frequency band.

Further, the periodic amplitude spectrum band expander 14 may generate the periodic amplitude spectrum in the high frequency band according to the formula (13) instead of the formula (11).

$$PP(f) = s(f)\sin\left(\frac{2\pi f}{T + c(f)dT(f)} + \theta_{fL}\right) \tag{13}$$

Here, the function PP(f) denotes the intensity of the periodic amplitude spectrum at a frequency f. In addition, the function c(f) is a function that increases as the frequency increases. The function s(f) denotes the envelope, and θfL denotes the phase of the frequency spectrum at the frequency fL. Further, T denotes the period of the periodic amplitude spectrum. Then, the function dT(f) is a random function, and the absolute value of dT(f) is included, for example, in the range of 10% to 20% of the period T of the periodic amplitude spectrum.

In the formula (13), by, as the frequency increases, increasing the contribution of the random function with respect to the period T of the periodic amplitude spectrum, the periodicity of the periodic amplitude spectrum weakens as the frequency increases. Alternatively, as another method, the periodic amplitude spectrum band expander 14 may add the random function to the function s(f), whereby the periodicity of the periodic amplitude spectrum weakens as the frequency increases. For example, in the formula (13), the periodic amplitude spectrum band expander 14 may use (s(f)+c(f)dT(f)) instead of the function s(f) and may set the coefficient of the frequency f in the sin function, to be (2π/T). Still alternatively, the periodic amplitude spectrum band expander 14 may use another method that weakens the periodicity of the periodic amplitude spectrum as the frequency increases. Still alternatively, for example, when the periodic amplitude spectrum is lower than the random amplitude spectrum, the periodic amplitude spectrum band expander 14 may generate the periodic amplitude spectrum in the high frequency band such that the period T is maintained regardless of the frequency.

Finally, the periodic amplitude spectrum band expander 14 outputs the periodic amplitude spectrum in the high frequency band to the spectrum synthesis unit 17.

The random amplitude spectrum band expander 15 expands the frequency band of the random amplitude spectrum received from the separator 12. For this, on the basis of the random amplitude spectrum received from the separator 12, the random amplitude spectrum band expander 15 generates a random amplitude spectrum in a high frequency band higher than the upper limit of the frequency band of the inputted voice signal. It is noted that the high frequency band is equal to the high frequency band of the periodic amplitude spectrum generated by the periodic amplitude spectrum band expander 14, and the high frequency band is, for example, 4 kHz to 8 kHz.

Figure 6:
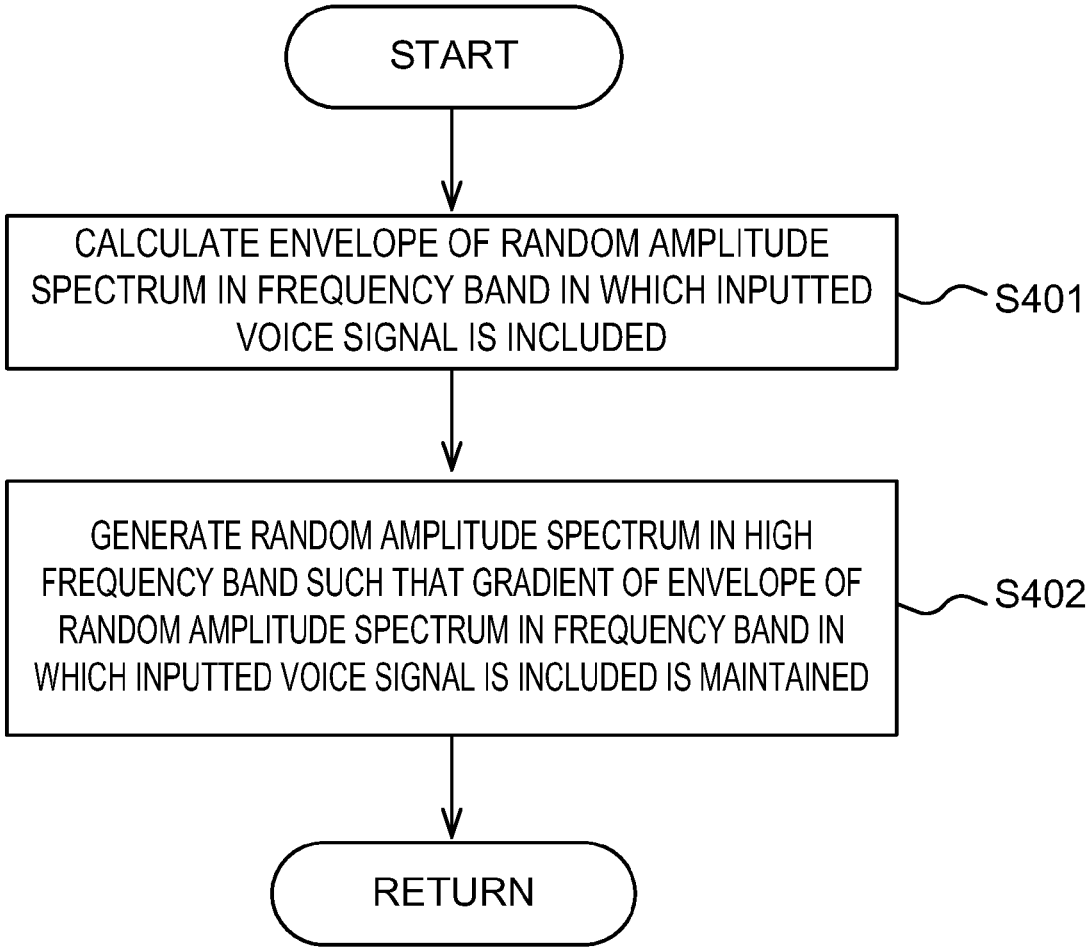
FIG. 6 is an operational flow chart of a high frequency band random amplitude spectrum generation process.

FIG. 6 is an operational flow chart of a high frequency band random amplitude spectrum generation process performed by the random amplitude spectrum band expander 15. The random amplitude spectrum band expander 15 calculates the envelope of the random amplitude spectrum (operation S401). It is noted that a specific method of calculating the envelope may be, for example, the same as the method of calculating the envelope of the periodic amplitude spectrum by the periodic amplitude spectrum band expander 14. Specifically, the random amplitude spectrum band expander 15 may calculate the envelope by obtaining local maximum points or local maximum points of the random amplitude spectrum, and using a least-squares method with respect to a set of these local maximum points or these local maximum points.

Next, the random amplitude spectrum band expander 15 generates the random amplitude spectrum in the high frequency band such that the gradient of the envelope of the random amplitude spectrum in the frequency band of the inputted voice signal is maintained (operation S402). The random amplitude spectrum band expander 15 may generate the random amplitude spectrum in the high frequency band, for example, according to the following formula (14).

$$PR(f)=sr(f)rr(f) \tag{14}$$

Here, the function PR(f) denotes the intensity of the random amplitude spectrum at a frequency f. In addition, the function sr(f) is a function of the envelope of the random amplitude spectrum calculated at operation S401. Further, the function rr(f) is a random function. In order that the reproduced voice becomes a natural voice, the random function rr(f) is set such that the absolute value of the random amplitude spectrum in the high frequency band becomes a random value that does not exceed the value of the envelope sr(f). For example, the value of the random function rr(f) is included in the range of −1 to 1.

The random amplitude spectrum band expander 15 outputs the random amplitude spectrum in the high frequency band to the spectrum synthesis unit 17.

The phase spectrum band expander 16 determines the phase of the frequency spectrum in the high frequency band. For example, the phase spectrum band expander 16 sets the phase with respect to the frequency f included in the high frequency band, to be the same value as the phase with respect to the frequency that is lower than the frequency f by a predetermined frequency. The predetermined frequency may be, for example, 4 kHz. Alternatively, the phase spectrum band expander 16 may set the phase with respect to the frequency f included in the high frequency band, to be the phase with respect to any one frequency included in the frequency band of the inputted voice signal.

It is noted that the phase spectrum band expander 16 determines the phase with respect to each frequency such that the phase with respect to each frequency is continuous between temporally-successive frames. Thus, the phase spectrum band expander 16 calculates, as an inferred phase, a phase with respect to each frequency at start of a focused frame, from: a phase with respect to each frequency, which phase is determined for the frame immediately prior to the focused frame; the frequency; and the frame length. Then, the phase spectrum band expander 16 obtains the phase difference between the inferred phase and the phase with respect to each frequency, which phase is determined for the focused frame as described above. If the phase difference is beyond a predetermined range, the phase spectrum band expander 16 corrects the phase such that the phase difference is included in the predetermined range.

For example, the phase spectrum band expander 16 determines the phase $\phi(f, t)$ with respect to the frequency f at frame t, which is included in the high frequency band, according to the following formulas (15) and (16).

$$\phi(f, t) = \phi(f - 4000, t) \tag{15}$$

$$\Delta\phi(f, t) = \phi(f, t) - \left(\phi(f, t-1) + \frac{2\pi f}{\Delta t}\right) \quad -\pi < \phi(f, t) \le \pi \tag{16}$$

In the formula (15), as a general rule, the phase at the frequency lower than the frequency f by 4 kHz is regarded as the phase at the frequency f. It is noted that, when the frequency lower than the frequency f by 4 kHz is included in a frequency band that does not exist in the inputted voice signal, the phase $\phi(f, t)$ is set to be any value, for example, 0.

Further, according to the formula (16), the phase spectrum band expander 16 calculates the phase difference $\Delta\phi(f, t)$ between the phase $\phi(f, t)$ at the frequency f, which is calculated according to the formula (15), and an inferred phase which is calculated from the phase $\phi(f, t-1)$ of the last frame $(t-1)$, the frequency f, and the frame length $\Delta t$. Then, when the phase difference $\Delta\phi(f, t)$ is greater than $(\pi-\Delta\pi)$, the phase spectrum band expander 16 subtracts $\pi/2$, which is an offset value, from the phase $\phi(f, t)$. On the other hand, when the phase difference $\Delta\phi(f, t)$ is smaller than $(-\pi+\Delta\pi)$, the phase spectrum band expander 16 adds $\pi/2$, which is the offset value, to the phase $\phi(f, t)$. It is noted that $\Delta\pi$ is a value corresponding to the maximum value of an allowable phase difference, and, for example, may be the maximum value of a phase difference by which a user does not notice a discontinuity of a reproduced sound that is caused by the phase shift. For example, $\Delta\pi$ is set to be $\pi/2$.

It is noted that, only for the initial frame, the phase spectrum band expander 16 may set the phase with respect to the frequency f included in the high frequency band, to be the same value as the phase with respect to the frequency lower than the frequency f by the predetermined frequency. Then, for frames subsequent to the initial frames, the phase spectrum band expander 16 may set the phase with respect to the frequency f included in the high frequency band, to be the above inferred phase. The phase spectrum band expander 16 outputs the phase spectrum in the high frequency band to the spectrum synthesis unit 17. Further, in order to be able to use the phase spectrum in the high frequency band for calculation of a phase spectrum for the next frame, the phase spectrum band expander 16 stores the phase spectrum in the high frequency band, in a memory of the voice band expansion device 1.

The spectrum synthesis unit 17 generates a frequency spectrum in the high frequency band by combining the envelope amplitude spectrum, the periodic amplitude spectrum, the random amplitude spectrum, and the phase spectrum in the high frequency band. Then, the spectrum synthesis unit 17 generates a broadband frequency spectrum by connecting the frequency spectrum in the high frequency band to the frequency spectrum of the frequency band of the inputted voice signal, which frequency spectrum is received from the time-frequency converter 11.

The spectrum synthesis unit 17 synthesizes the frequency spectrum in the high frequency band according to the following formula (17).

$$BR(f)=(PE(f)\cdot(PP(f)+PR(f)))\cdot\cos(\phi(f))$$

$$BI(f)=(PE(f)\cdot(PP(f)+PR(f)))\cdot\sin(\phi(f)) \quad (17)$$

It is noted that the function BR(f) denotes the real part of the synthesized frequency spectrum, and the function BI(f) denotes the imaginary part of the synthesized frequency spectrum. In addition, the function PE(f) denotes the envelope amplitude spectrum in the high frequency band, and the function PP(f) denotes the periodic amplitude spectrum in the frequency band, which is generated by the periodic amplitude spectrum band expander 14. Further, the function PR(f) denotes the random amplitude spectrum in the high frequency band, which is generated by the random amplitude spectrum band expander 15, and the function $\phi(f)$ denotes the phase spectrum in the high frequency band, which is generated by the phase spectrum band expander 16. The spectrum synthesis unit 17 outputs the generated broadband frequency spectrum to the frequency-time converter 18.

The frequency-time converter 18 generates a voice signal whose frequency band is expanded in a pseudo manner, by performing frequency-time conversion on the broadband frequency spectrum received from the spectrum synthesis unit 17. It is noted that the frequency-time conversion performed by the frequency-time converter 18 is the inverse transform of the time-frequency conversion performed by the time-frequency converter 11. Then, the frequency-time converter 18 outputs the generated voice signal.

Figure 7:
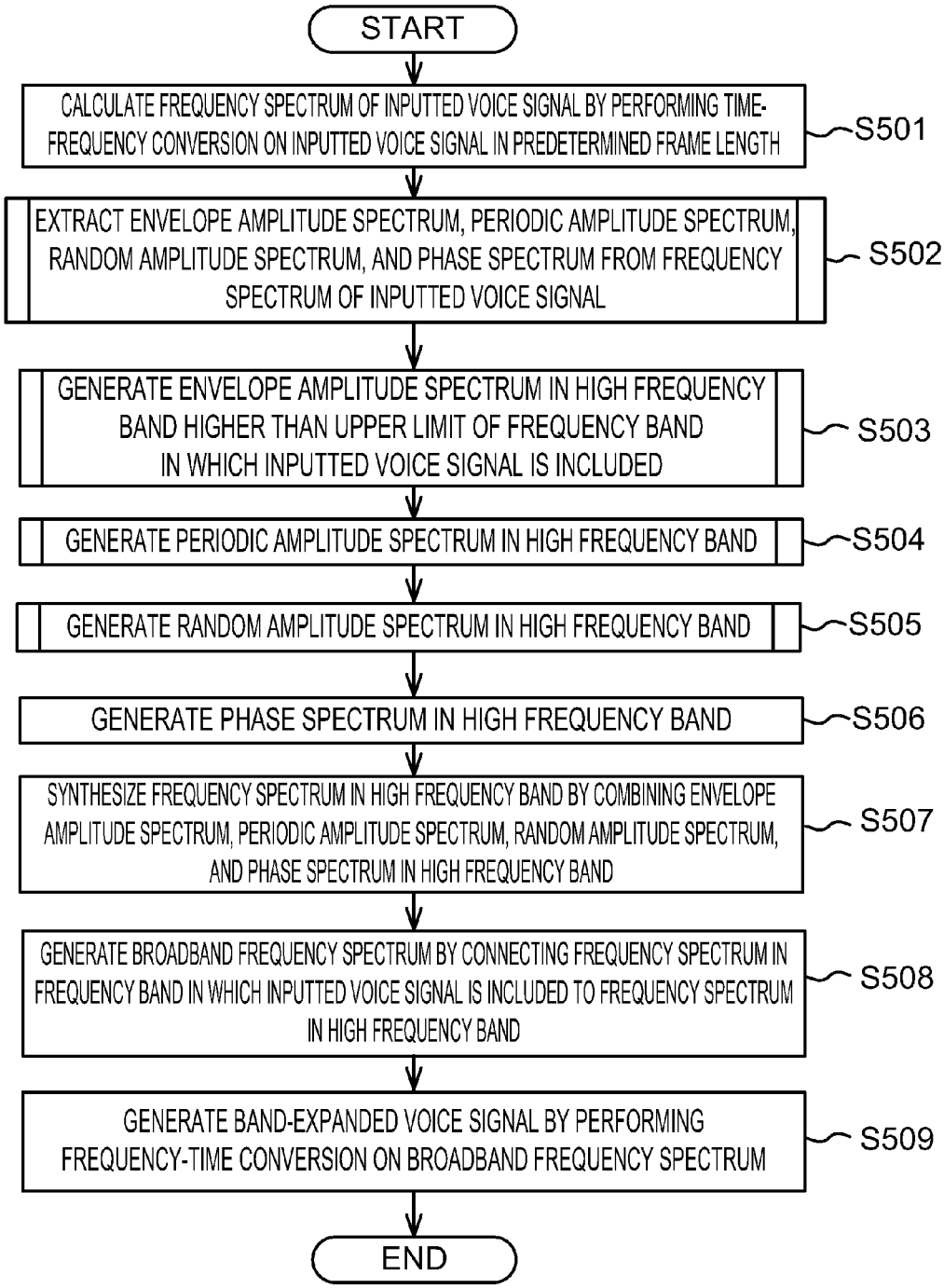
FIG. 7 is an operational flow chart of a voice band expansion process performed by the voice band expansion device according to the embodiment.

FIG. 7 is an operational flow chart of a voice band expansion process performed by the voice band expansion device 1 on a voice signal having a one-frame length. It is noted that the voice band expansion device 1 repeatedly performs the voice band expansion process, shown in FIG. 7, multiple times that are equal to the number of frames included in the inputted voice signal. First, the time-frequency converter 11 calculates a frequency spectrum of the inputted voice signal by performing time-frequency conversion in a predetermined frame unit on an inputted voice signal read from the buffer memory 10 (operation S501). Then, every time a frequency spectrum is calculated in the predetermined frame unit, the time-frequency converter 11 outputs the calculated frequency spectrum to the separator 12 and the spectrum synthesis unit 17.

Every time a frequency spectrum is received from the time-frequency converter 11, the separator 12 extracts an envelope amplitude spectrum, a periodic amplitude spectrum, a random amplitude spectrum, and a phase spectrum from the frequency spectrum (operation S502). The separator 12 passes the envelope amplitude spectrum to the envelope amplitude spectrum band expander 13. In addition, the separator 12 passes the original frequency spectrum, the periodic amplitude spectrum, the maximum value of a cepstrum and a quefrency Qmax corresponding to this maximum value, to the periodic amplitude spectrum band expander 14. Further, the separator 12 passes the random amplitude spectrum to the random amplitude spectrum band expander 15. Then, the separator 12 passes the original frequency spectrum and the phase spectrum to the phase spectrum band expander 16.

After operation S502, on the basis of the envelope amplitude spectrum received from the separator 12, the envelope amplitude spectrum band expander 13 generates an envelope amplitude spectrum in a high frequency band higher than the upper limit of the frequency band in which the inputted voice signal is included (operation S503). Then, the envelope amplitude spectrum band expander 13 outputs the envelope amplitude spectrum in the high frequency band to the spectrum synthesis unit 17. In addition, on the basis of the periodic amplitude spectrum received from the separator 12, the periodic amplitude spectrum band expander 14 generates a periodic amplitude spectrum in the high frequency band (operation S504). Then, the periodic amplitude spectrum band expander 14 outputs the periodic amplitude spectrum in the high frequency band to the spectrum synthesis unit 17.

Further, on the basis of the random amplitude spectrum received from the separator 12, the random amplitude spectrum band expander 15 generates a random amplitude spectrum in the high frequency band (operation S505). Then, the random amplitude spectrum band expander 15 outputs the random amplitude spectrum in the high frequency band to the spectrum synthesis unit 17. Moreover, on the basis of the phase spectrum received from the separator 12, the phase spectrum band expander 16 generates a phase spectrum in the high frequency band (operation S506). Then, the random amplitude spectrum band expander 15 outputs the generated phase spectrum in the high frequency band to the spectrum synthesis unit 17.

After operation S506, the spectrum synthesis unit 17 synthesizes a frequency spectrum in the high frequency band by combining the envelope amplitude spectrum, the periodic amplitude spectrum, the random amplitude spectrum, and the phase spectrum in the high frequency band (operation S507). Then, the spectrum synthesis unit 17 generates a broadband frequency spectrum by connecting the frequency spectrum in the frequency band of the inputted voice signal to the frequency spectrum in the high frequency band (operation S508). The spectrum synthesis unit 17 outputs the broadband frequency spectrum to the frequency-time converter 18.

Finally, the frequency-time converter 18 generates a voice signal whose frequency band is expanded in a pseudo manner, by performing frequency-time conversion on the broadband frequency spectrum received from the spectrum synthesis unit 17 (operation S509). It is noted that the voice band expansion device 1 may change the performing order of the above processes at operations S503 to 506. Alternatively, the voice band expansion device 1 may perform the above processes at operations S503 to 506 in parallel.

As described above, the voice band expansion device according to the present embodiment extracts the envelope amplitude spectrum, the periodic amplitude spectrum, the random amplitude spectrum, and the phase spectrum from the frequency spectrum of the inputted voice signal, and expands the frequency band of each spectrum in accordance with its characteristic. Thus, the voice band expansion device may expand the frequency band of the amplitude spectrum while maintaining the characteristic of each spectrum in the frequency band of the inputted voice signal. Further, the voice band expansion device suppresses a discontinuity of the phase of the frequency spectrum with respect to each frequency included in the high frequency band between successive frames, and thus may prevent the reproduced voice from being discontinuous. Therefore, the voice band expansion device may improve the quality of the reproduced voice.

According to an alternative embodiment, when it is assumed that a discontinuity of a reproduced voice falls within a range allowable for the user, the voice band expansion device may not have the phase spectrum band expander. In this case, the separator of the voice band expansion device does not calculate the phase spectrum from the frequency spectrum. Instead, for example, the spectrum synthesis unit of the voice band expansion device may set the phase of the frequency spectrum with respect to each frequency included in the high frequency band, to be a predetermined set value.

Figure 8:
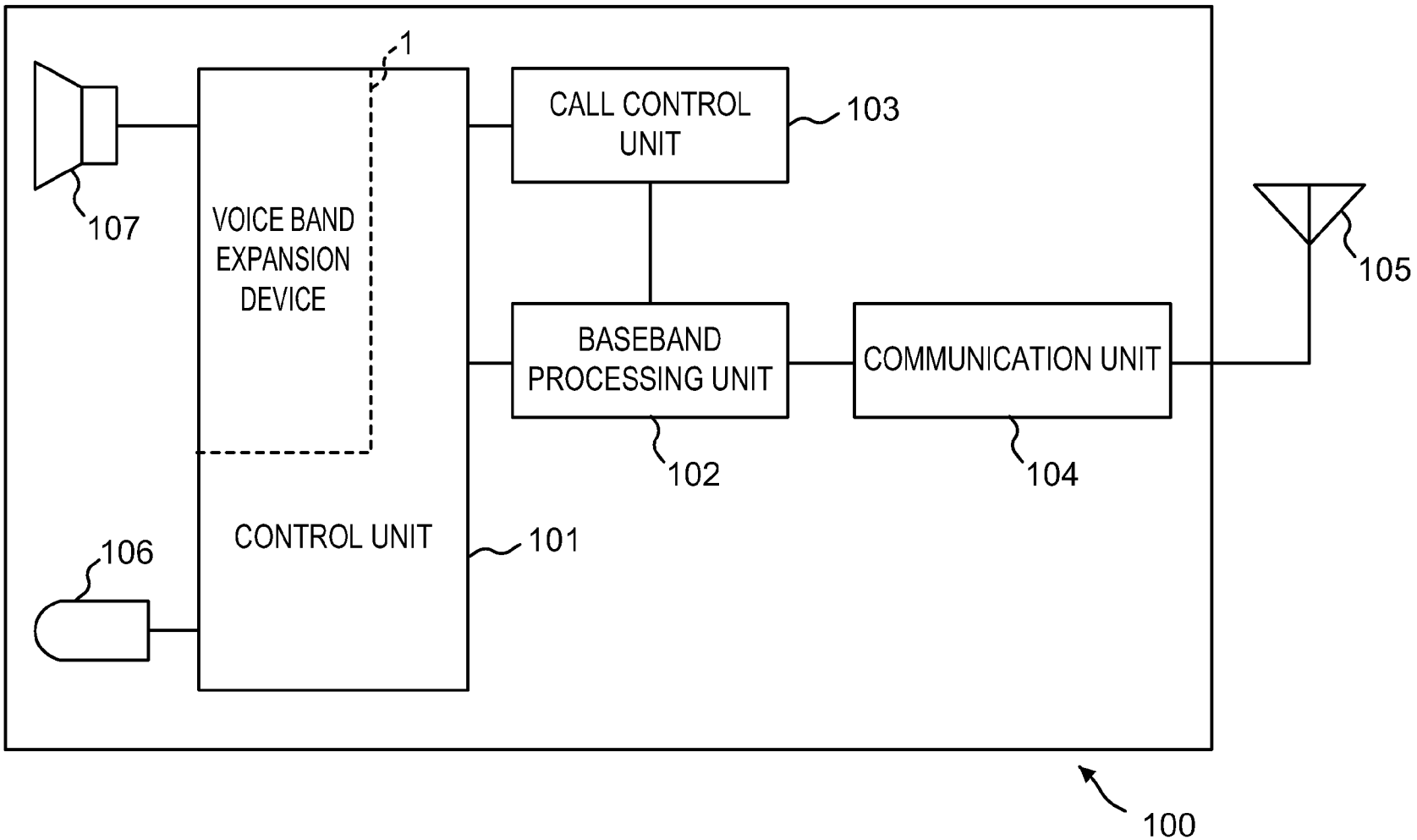
FIG. 8 is a schematic configuration diagram of a communication apparatus in which the voice band expansion device is incorporated.

FIG. 8 is a schematic configuration diagram of a communication apparatus in which the aforementioned voice band expansion device is incorporated. A communication apparatus 100 includes a controller 101, a baseband processor 102, a call controller 103, a communication unit 104, an antenna 105, a microphone 106, and a loudspeaker 107. The controller 101, the baseband processor 102, the call controller 103, and the communication unit 104 may be separate circuits, respectively, or these units may be integrated into one integrated circuit. Further, one example of the communication apparatus is a telephone.

The controller 101 controls the entire communication apparatus 100. The controller 101 executes various application programs that run on the communication apparatus 100. For this, the controller 101 has a processor, a nonvolatile memory, and a volatile memory. After an application for performing communication such as telephone call is activated by an operation performed by a user using an operation unit (not shown), such as a keypad, of the communication apparatus 100, the controller 101 activates the call controller 103 according to the application.

Further, the controller 101 performs a source coding process on a voice signal obtained from the microphone 106. Then, the controller 101 passes the resultant signal as an uplink signal to the baseband processor 102. In addition, upon receipt of a downlink signal from the baseband processor 102, the controller 101 decodes the source-coded voice signal. Moreover, the controller 101 has the above voice band expansion device 1. The controller 101 performs a process of expanding the frequency band of the decoded voice signal. Then, the controller 101 causes the loudspeaker 107 to reproduce the voice signal whose frequency band has been expanded.

The baseband processor 102 receives the uplink signal from the controller 101, performs a coding process for error correction such as convolutional coding and turbo coding, and a transmission process such as a diffusion process, on the uplink signal, and outputs the coded uplink signal to the communication unit 104. In addition, the baseband processor 102 performs a reception process such as a back diffusion process and an error correction decoding process on a downlink signal received from the communication unit 104. Then, the baseband processor 102 outputs the downlink signal that has been subjected to the reception process, to the controller 101.

The call controller 103 performs a call control process, such as call, reply, disconnection, between the communication apparatus 100 and a base-station apparatus. Then, the call controller 103 instructs the baseband processor 102 to initiate or terminate its operation in accordance with the result of the call control process.

The communication unit 104 performs a quadrature modulation process such as Differential Quadrature Phase Shift Keying (DQPSK) on the coded uplink signal received from the baseband processor 102. The communication unit 104 superimposes the quadrature-modulated uplink signal on a carrier wave having a radio frequency. Then, the communication unit 104 amplifies the uplink signal superimposed on the carrier wave, and transmits the amplified uplink signal via the antenna 105. Further, the communication unit 104 receives a downlink signal transmitted from a base station, via the antenna 105. Then, the communication unit 104 amplifies the received downlink signal. The communication unit 104 demodulates the amplified downlink signal. The communication unit 104 passes the demodulated downlink signal to the baseband processor 102.

As described above, the communication apparatus in which the voice band expansion device according to the embodiment is incorporated expands the frequency band of the received voice signal in a pseudo manner, and thus may improve the quality of a reproduced voice. In particular, the communication apparatus extracts the envelope amplitude spectrum, the periodic amplitude spectrum, a random amplitude spectrum, and the phase spectrum from the frequency spectrum of the received voice signal, and individually expands the frequency band of each spectrum in accordance with its characteristic. Thus, the communication apparatus may expand the frequency band of each amplitude spectrum while maintaining the characteristic of each spectrum in the frequency band of the voice signal. Further, the communication apparatus suppresses a discontinuity of the phase of the frequency spectrum with respect to each frequency included in the high frequency band between successive frames, and thus may prevent the reproduced voice from being discontinuous. Therefore, the communication apparatus may improve the quality of the reproduced voice.

It is noted that the voice band expansion method described in the embodiment can be implemented by a previously-prepared program being executed by a computer such as a personal computer and a work station. The voice band expansion program is recorded on a computer-readable recording medium such as a hard disk, a flexible disk, a CD-ROM, an MO, and a DVD, and read from the recording medium by the computer for execution. Alternatively, the voice band expansion program may be distributed via a network such as the Internet.

All examples and conditional language recited herein are intended for pedagogical purpose to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A voice band expansion device comprising:

a time-frequency converter that calculates, using a processor, a frequency spectrum of a voice signal having a first frequency band, by performing time-frequency conversion on the voice signal every frame having a predetermined time length;

a separator that extracts, from the frequency spectrum, an envelope amplitude spectrum of the frequency spectrum, a periodic amplitude spectrum whose spectrum intensity periodically changes in response to frequency, and a random amplitude spectrum whose spectrum intensity randomly changes in response to frequency;

an envelope amplitude spectrum band expander that expands a frequency band of the envelope amplitude spectrum to a second frequency band that is different from the first frequency band;

a periodic amplitude spectrum band expander that expands a frequency band of the periodic amplitude spectrum to the second frequency band;

a random amplitude spectrum band expander that expands a frequency band of the random amplitude spectrum to the second frequency band;

a broadband spectrum calculator that calculates a broadband frequency spectrum having the first frequency band and the second frequency band, by combining the band-expanded envelope amplitude spectrum, the band-expanded periodic amplitude spectrum, and the band-expanded random amplitude spectrum; and a frequency-time converter that generates a voice signal having the first frequency band and the second frequency band, by performing frequency-time conversion on the broadband frequency spectrum.

2. The device according to claim 1, wherein the periodic amplitude spectrum band expander calculates an envelope of the periodic amplitude spectrum in the first frequency band, and expands the frequency band of the periodic amplitude spectrum so as to maintain the envelope also in the second frequency band.

3. The device according to claim 1, wherein the periodic amplitude spectrum band expander weakens a periodicity of the band-expanded periodic amplitude spectrum with respect to a frequency as the frequency increases in the second frequency band.

4. The device according to claim 1, wherein the random amplitude spectrum band expander calculates an envelope of the random amplitude spectrum in the first frequency band, and expands the frequency band of the random amplitude spectrum so as to maintain the envelope also in the second frequency band.

5. The device according to claim 1, further comprising:

a phase spectrum band expander that expands, to the second frequency band, a frequency band of the phase spectrum that indicates a phase of the frequency spectrum with respect to each frequency included in the first frequency band, wherein the broadband spectrum calculator synthesizes the broadband frequency spectrum by combining the band-expanded envelope amplitude spectrum, the band-expanded periodic amplitude spectrum, the band-expanded random amplitude spectrum, and the band-expanded phase spectrum.

6. The device according to claim 5, wherein the phase spectrum band expander determines a phase of the frequency spectrum with respect to a predetermined frequency included in the second frequency band at a first frame, such that a phase of the frequency spectrum with respect to the predetermined frequency, which phase is determined at a second frame prior to the first frame, and a phase at start of the first frame, which phase is calculated from the predetermined frequency and the frame length, are continuous with each other.

7. A voice band expansion method comprising:

calculating, using a processor, a frequency spectrum of a voice signal having a first frequency band, by performing time-frequency conversion on the voice signal every frame having a predetermined time length;

extracting, from the frequency spectrum, an envelope amplitude spectrum of the frequency spectrum, a periodic amplitude spectrum whose spectrum intensity periodically changes in response to frequency, and a random amplitude spectrum whose spectrum intensity randomly changes in response to frequency;

expanding a frequency band of the envelope amplitude spectrum to a second frequency band that is different from the first frequency band;

expanding a frequency band of the periodic amplitude spectrum to the second frequency band;

calculating a broadband frequency spectrum having the first frequency band and the second frequency band, by combining the band-expanded envelope amplitude spectrum, the band-expanded periodic amplitude spectrum, and the band-expanded random amplitude spectrum; and generating a voice signal having the first frequency band and the second frequency band, by performing frequency-time conversion on the broadband frequency spectrum.

8. The method according to claim 7, wherein the frequency band of the periodic amplitude spectrum is expanded by calculating an envelope of the periodic amplitude spectrum in the first frequency band, and expanding the frequency band of the periodic amplitude spectrum so as to maintain the envelope also in the second frequency band.

9. The method according to claim 7, wherein the frequency band of the periodic amplitude spectrum is expanded by weakening a periodicity of the band-expanded periodic amplitude spectrum with respect to a frequency as the frequency increases in the second frequency band.

10. The method according to claim 7, wherein the frequency band of the random amplitude spectrum is expanded by calculating an envelope of the random amplitude spectrum in the first frequency band, and expanding the frequency band of the random amplitude spectrum so as to maintain the envelope also in the second frequency band.

11. The method according to claim 7, further comprising:

expanding a phase spectrum band to the second frequency band, a frequency band of the phase spectrum that indicates a phase of the frequency spectrum with respect to each frequency included in the first frequency band, wherein the calculating a broadband frequency spectrum synthesizes the broadband frequency spectrum by combining the band-expanded envelope amplitude spectrum, the band-expanded periodic amplitude spectrum, the band-expanded random amplitude spectrum, and the band-expanded phase spectrum.

12. The method according to claim 11, wherein the expanding a phase spectrum band determines a phase of the frequency spectrum with respect to a predetermined frequency included in the second frequency band at a first frame, such that a phase of the frequency spectrum with respect to the predetermined frequency, which phase is determined at a second frame prior to the first frame, and a phase at start of the first frame, which phase is calculated from the predetermined frequency and the frame length, are continuous with each other.

13. A communication apparatus comprising:

a communication unit that receives a coded voice signal having a first frequency band;

a baseband processor that decodes the voice signal;

a controller that expands the first frequency band of the voice signal, the controller comprising:

a time-frequency converter that calculate a frequency spectrum of the voice signal having the first frequency band, by performing time-frequency conversion on the voice signal every frame having a predetermined time length;

a separator that extracts, from the frequency spectrum, an envelope amplitude spectrum of the frequency spectrum, a periodic amplitude spectrum whose spectrum intensity periodically changes in response to frequency, and a random amplitude spectrum whose spectrum intensity randomly changes in response to frequency;

an envelope amplitude spectrum band expander that expands a frequency band of the envelope amplitude spectrum to a second frequency band that is different from the first frequency band;

a periodic amplitude spectrum band expander that expands a frequency band of the periodic amplitude spectrum to the second frequency band;

a random amplitude spectrum band expander that expands a frequency band of the random amplitude spectrum to the second frequency band;

a broadband spectrum calculator that calculates a broadband frequency spectrum having the first frequency band and the second frequency band, by combining the band-expanded envelope amplitude spectrum, the band-expanded periodic amplitude spectrum, and the band-expanded random amplitude spectrum; and a frequency-time converter that generates a voice signal having the first frequency band and the second frequency band, by performing frequency-time conversion on the broadband frequency spectrum; and a loudspeaker that reproduces the band-expanded voice signal.

14. The apparatus according to claim 13, wherein the periodic amplitude spectrum band expander calculates an envelope of the periodic amplitude spectrum in the first frequency band, and expands the frequency band of the periodic amplitude spectrum so as to maintain the envelope also in the second frequency band.

15. The apparatus according to claim 13, wherein the periodic amplitude spectrum band expander weakens a periodicity of the band-expanded periodic amplitude spectrum with respect to a frequency as the frequency increases in the second frequency band.

16. The apparatus according to claim 13, wherein the random amplitude spectrum band expander calculates an envelope of the random amplitude spectrum in the first frequency band, and expands the frequency band of the random amplitude spectrum so as to maintain the envelope also in the second frequency band.

17. The apparatus according to claim 13, further comprising:

a phase spectrum band expander that expands, to the second frequency band, a frequency band of the phase spectrum that indicates a phase of the frequency spectrum with respect to each frequency included in the first frequency band, wherein the broadband spectrum calculator synthesizes the broadband frequency spectrum by combining the band-expanded envelope amplitude spectrum, the band-expanded periodic amplitude spectrum, the band-expanded random amplitude spectrum, and the band-expanded phase spectrum.

18. The apparatus according to claim 17, wherein the phase spectrum band expander determines a phase of the frequency spectrum with respect to a predetermined frequency included in the second frequency band at a first frame, such that a phase of the frequency spectrum with respect to the predetermined frequency, which phase is determined at a second frame prior to the first frame, and a phase at start of the first frame, which phase is calculated from the predetermined frequency and the frame length, are continuous with each other.

* * * * *